US006364622B1

(12) United States Patent
Lishanski et al.

(10) Patent No.: US 6,364,622 B1
(45) Date of Patent: Apr. 2, 2002

(54) VIBRATORY PUMP APPARATUS

(76) Inventors: Grigori Lishanski, 10112 W. Sharon La., Milwaukee, WI (US) 53225; Oleg Lishanski, 805 Weidner Ct. S., Buffalo Grove, IL (US) 60089

( * ) Notice: Subject to any disclaimer, the term of this patent is extended or adjusted under 35 U.S.C. 154(b) by 0 days.

(21) Appl. No.: 09/595,856

(22) Filed: Jun. 16, 2000

Related U.S. Application Data

(60) Provisional application No. 60/140,062, filed on Jun. 21, 1999.

(51) Int. Cl.[7] ..... F04B 27/06
(52) U.S. Cl. ..... 417/53; 417/53
(58) Field of Search ..... 417/460, 53

(56) References Cited

U.S. PATENT DOCUMENTS 5,921,759 A * 7/1999 Khan ..... 417/460

FOREIGN PATENT DOCUMENTS

| | | |
|---|---|---|
| RU | 706573 | 9/1974 |
| RU | 877146 | 7/1981 |
| RU | 879051 | 7/1981 |
| RU | 918575 | 12/1981 |
| RU | 989166 | 9/1982 |
| RU | 1090930 | 1/1984 |
| RU | 1222905 | 12/1985 |
| RU | 1642095 | 12/1990 |
| RU | 1664387 | 7/1991 |

* cited by examiner

*Primary Examiner*—Charles G. Freay
(74) *Attorney, Agent, or Firm*—Boyle, Fredrickson, Newholm, Stein & Gratz, S.C.

(57) ABSTRACT

A vibratory pump including an oscillating chamber disposed within a pump case. The chamber is connected to a shaft of a vibration generator and repeatedly contacts a resilient member located inside the pump case. The chamber traps the fluid inside the chamber when contacting the resilient member, forcing that water out a nozzle connected to the chamber. When the chamber moves away from the resilient member, a slight vacuum is created that draws more fluid into the chamber for transfer through the nozzle.

13 Claims, 5 Drawing Sheets

VIBRATORY PUMP APPARATUS

This application is based on and claims priority from provisional patent application No. 60/140,062 filed on Jun. 21, 1999.

FIELD OF THE INVENTION

The present invention relates to pumps for displacing liquids.

BACKGROUND AND SUMMARY OF THE INVENTION

To move fluid from one place to another, pumps are often used. In doing so, the pumps create a localized pressure differential that results in a motive force, i.e., a vacuum, which displaces the fluid. Most conventional pumps are very adequate in performing this task, but in each case these pumps cannot transfer precise amounts of the fluids due to the residual pressure differential, or back pressure, created by the pump during the fluid transfer.

The present invention is a vibratory pump apparatus that allows an individual to pump liquids to a desired location without encountering problems after the device has been switched off due to the residual pressure differential remaining in prior art liquid pumping devices. Also, due to the use of inert materials in forming the apparatus, the apparatus may be used to pump caustic liquids, such as acids, without damaging the apparatus.

DETAILED DESCRIPTION OF THE INVENTION

Figure 1:
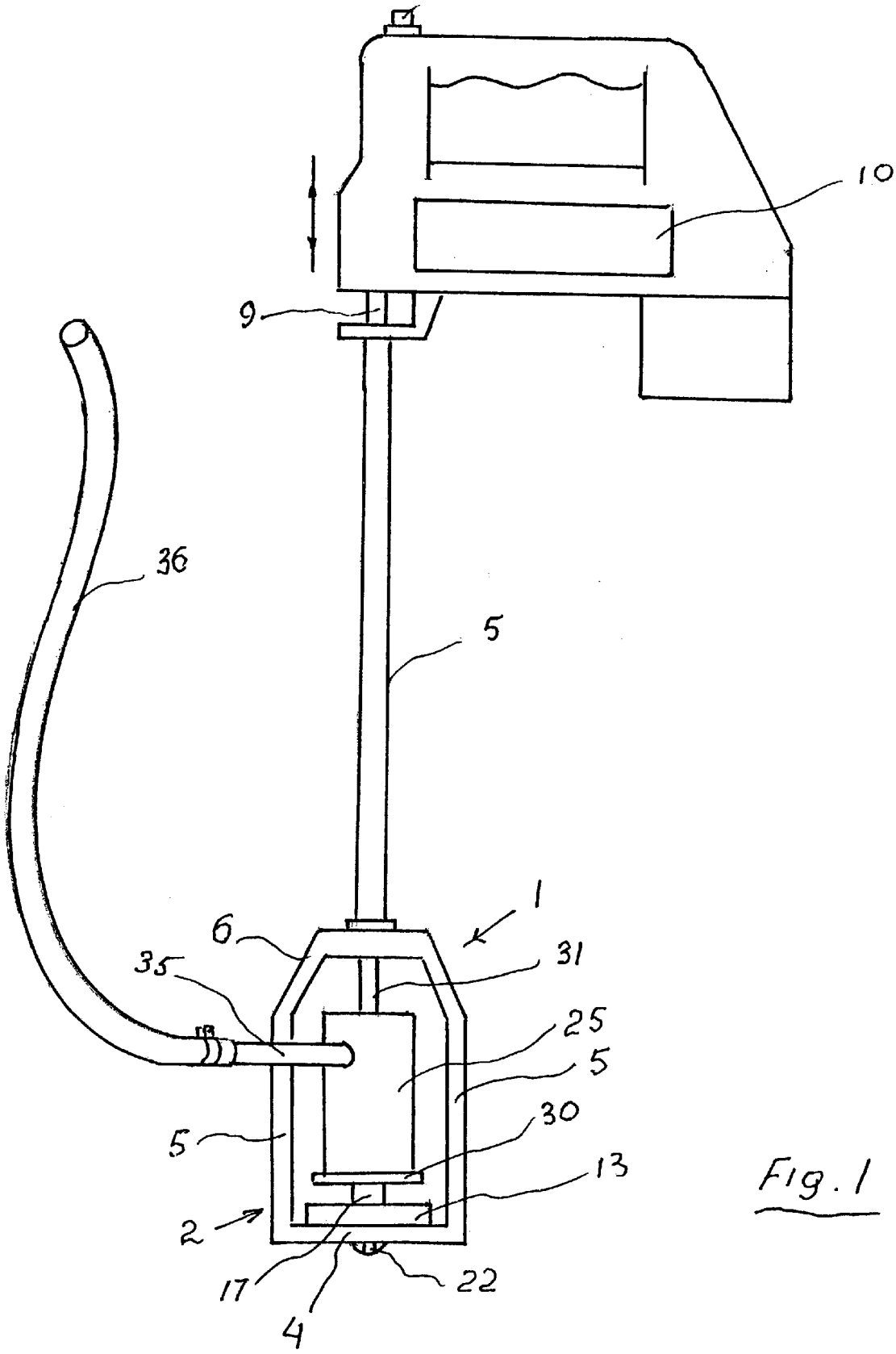
FIG. 1 is a front plan view of a vibratory pump apparatus constructed according to the present invention.
Figure 2:
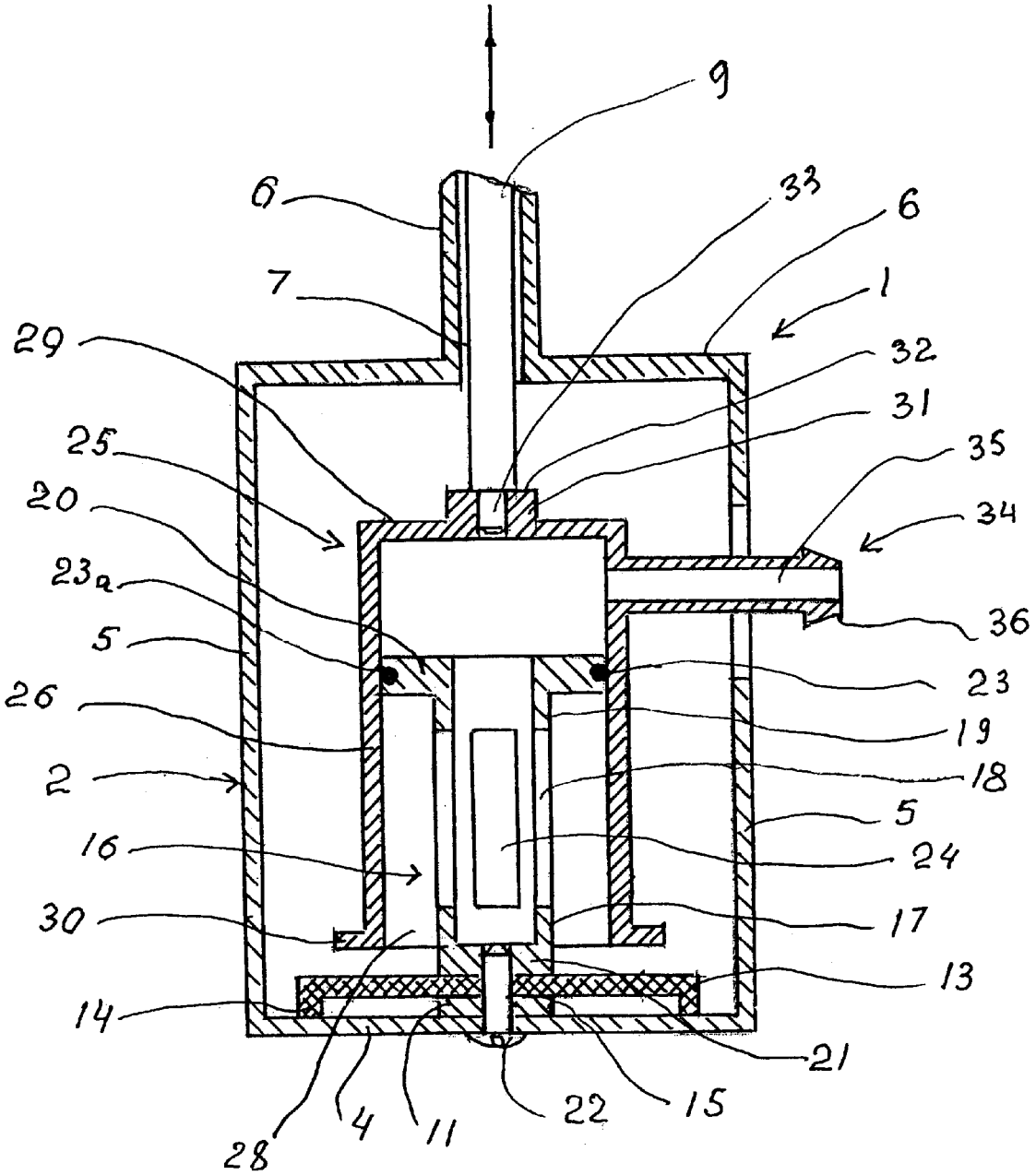
FIG. 2 is a cross-sectional view of an inlet branch pipe utilized in the vibratory pump apparatus of FIG. 1

The present invention is a vibratory pump apparatus including a new and novel inlet branch pipe 1 attached to a vibration generator 10, as shown in FIGS. 1 and 2. The inlet branch pipe 1 includes a pump case 2 that forms the body of the pipe 1. The pump case 2 is formed of an inert material, such as plastic, is generally cylindrical in shape, and is comprised of a circular base 4, a pair of wall members 5 upwardly extending perpendicular to the base 4, and a cover 6 connected to the wall members 5 opposite the base 4. The pump case 2 has a generally open interior, with the wall members 5 covering only a small portion of the circumference on either side of the pump case 2.

The cover 6 of the pump case 2 includes a central opening 7 around which is connected an inlet sleeve 8. The sleeve 8 extends away from the pump case 2 and is adapted to receive and engage a shaft 9 extending from a vibration generator 10. The generator 10 can be any suitable machine capable of producing regular, steady vibrations in a shaft 9 extending from the generator 10. Common types of these generators include electromagnetic vibration generators that are electrically or battery operated.

The base 4 of the pump case 2 includes a small annular shoulder 11 disposed about the center of base 4. The shoulder 11 includes a circular opening 12 disposed at its center extending completely through the shoulder 11 and base 4, as shown in FIG. 2. Opposite the base 4, the shoulder 11 supports one side of a flexible member 13. The member 13 is circular in shape and includes a downwardly extending peripheral ridge 14 which contacts the base 4 around the shoulder 11. The member 13 also includes a central opening 15 that aligns with the opening 12 in the shoulder 11.

Disposed directly above the flexible member 13 is a stationary plunger 16 which is generally cylindrical in shape. The plunger 16 includes a base 17 positioned against flexible member 13, an upwardly extending cylindrical wall 18 that includes a number of oval passages 24 extending through the wall, and a cap 19 that includes an outwardly extending radial flange 20. The plunger 16 has an opening 21 disposed in the center of the circular base 17 that aligns with openings 15 and 12 in the flexible member 13 and raised shoulder 11, respectively, when positioned within the pump case 2. The plunger 16 may be secured in this position by threadably engaging a fastener 22 within the respective openings from the lower end of the pump case 2. In this manner, the plunger 16 is rigidly held within the pump case and serves as a conduit for fluid flow during operation of the pump.

Opposite the base 17, the plunger 16 includes a concave groove 23*a* in the outer edge of the radial flange 20. A resilient O-ring 23 is disposed within the groove and serves to provide a reliable fluid seal between the O-ring and the interior surface of a mobile chamber 25 positioned about the plunger 16.

The mobile chamber 25 is cylindrical in shape and is comprised of a circular side wall 26 having an inner diameter slightly less than the diameter of the O-ring 23. The chamber 25 includes a bottom, open end 28 and a top, closed end 29. The open end 28 of the chamber 25 allows the top 19 of plunger 16 to be inserted into the chamber such that the O-ring 23 sealingly engages the interior of the chamber. The open end 28 also includes an outwardly extending radial flange 30 that contacts the flexible member 13 during operation of the apparatus.

The closed end 29 includes a raised shoulder 31 extending upwardly from the closed end. The shoulder 31 includes an opening 32 that threadedly engages the lowermost portion 33 of the shaft 9 to secure the chamber 25 onto the shaft 9 such that vibration of the shaft affects the vibration of the chamber.

Adjacent the closed end 29 of the chamber 25 is also located an outlet 34 extending perpendicularly to the axis of the chamber 25. The outlet 34 is generally cylindrical in shape and includes a channel 35 that is in fluid communication with the interior of the chamber 25. When the plunger 16 is positioned within the chamber 25, the closed end 29 forms a fluid pumping enclosure 37 between the top 19 of the plunger 16 that is in fluid communication with the outlet 34. The outlet 34 extends beyond the pump case 2 and includes an outwardly extending angled flange 36 used to securely connect a hose 38 to the outlet 34 to direct the fluid flowing through the outlet to a desired location.

In operation, the plunger 16 is inserted with the chamber 25 and both parts are removably positioned inside the pump case 2. The plunger is then secured to the base 4 by fastener 22 and the shaft 9 is inserted into the sleeve 8 of the pump case 2. The lowermost portion 33 of the shaft 9 is then threadedly engaged with the opening 32 in the chamber 25 such that the chamber is positioned about 1–2.5 mm above the flexible member 13, a distance corresponding to the stroke length of the shaft 9. Next, hose 38 is connected to the outlet 34 about the angled flange 36 in order to direct the outgoing fluid flow. Then pump case 2 is inserted into the liquid that is to be pumped and the vibration vibrator 10 is activated.

Typically, the generator 10 will operate between 30–100 cycles per second, with a convenient value of 60 cycles per second to correspond to conventional AC current. However, as the chamber 25 is positioned a fixed distance from the flexible member 13, the generator can operate between 10–150 cycles per second, depending upon the use to which the pump is put. Activation of the generator 10 begins a constant upward and downward movement of the shaft 9. As the shaft 9 is connected to the moveable chamber 25, the chamber 25 moves in conjunction with the shaft.

On the upward stroke, fluid flows past the wall members 5 into the interior of the pump case 2. When the chamber 25 is positioned above the flexible member 13, a portion of the incoming fluid flows upwardly into the interior of the chamber 25 and passes through the passages 24 in the cylindrical portion 18 of the plunger 16. From the plunger, the fluid flows upwardly into the enclosure 37 formed between the top portion 19 of the plunger 16 and the closed end 29 of the chamber 25 to fill the enclosure.

On the downward stroke, the O-ring 23 disposed in the radially extending flange 20 on the plunger 16 prevents any liquid from flowing downwardly around the exterior of the plunger between the flange 20 and the side wall 26 of the chamber 25. This seal, along with the force exerted by the fluid flowing upwardly through the plunger 16, exerts a pressure on the fluid contained within the enclosure 37, forcing that fluid through the outlet 34 and into the hose 38. When the chamber 25 reaches the lowermost extent of the stroke, the outwardly extending flange 30 on the chamber 25 contacts the flexible member 13 to create a momentary fluid seal between the flange 30 and flexible member 13. In connection with this seal, the outwardly flowing fluid creates a slight vacuum within the chamber 25, such that when the chamber rises off of the member 13 in the following upward stroke, fluid is drawn into the interior of the chamber to refill the enclosure 37.

Figure 3:
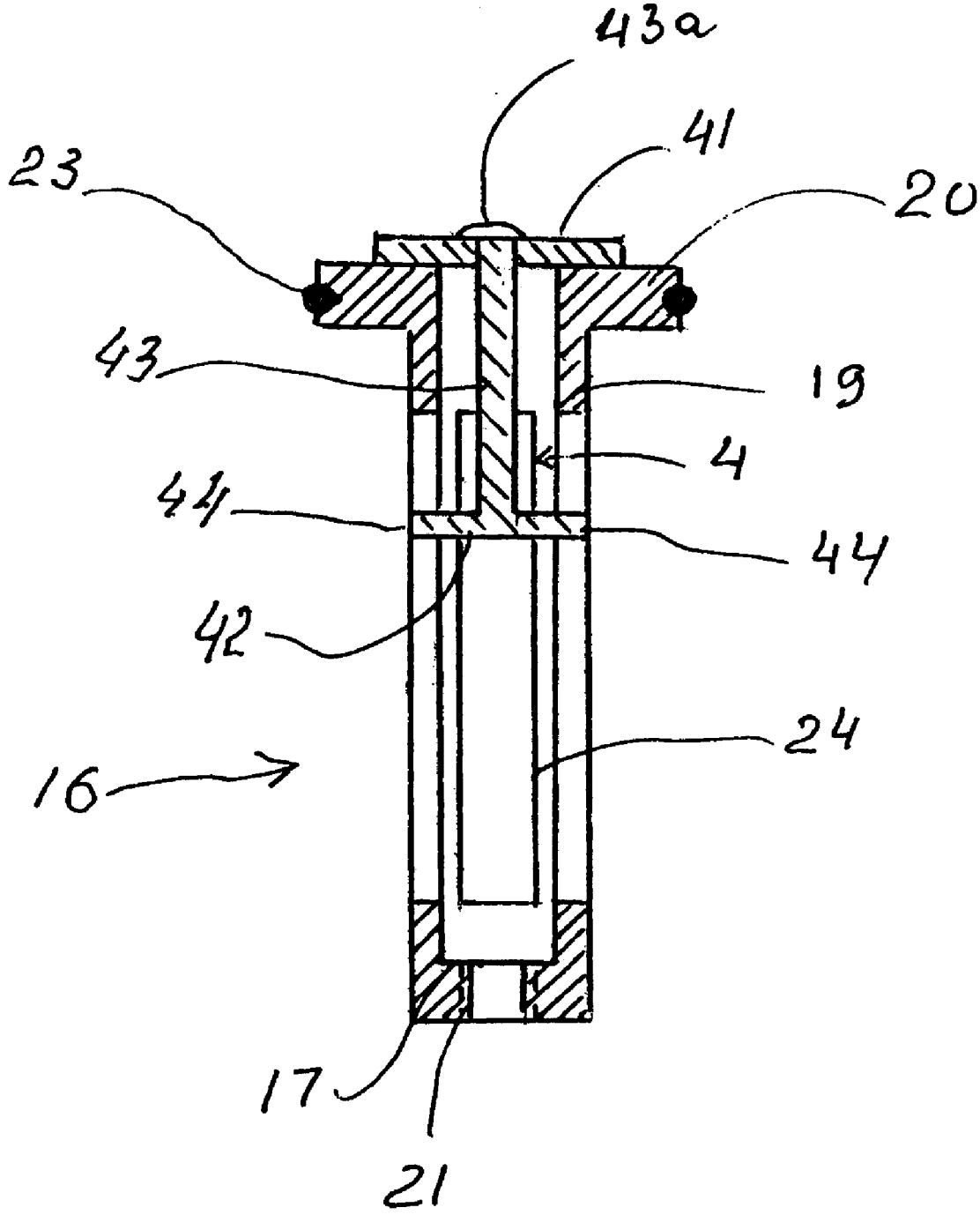
FIG. 3 is a cross-sectional view of a component of an alternative construction of the inlet branch pipe of FIG. 2.

To modify the design of this pump case 2 to provide for an increased pressure for the fluid flow exiting the pump, the plunger 16 can be altered to have the configuration shown in FIG. 3. In this alternative structure, a moveable sealing member 40 is positioned partially within the cylindrical portion 18 of the plunger 16. The sealing member 40 includes a generally circular, bottom end 42, a stem 43 extending upwardly perpendicular from the bottom end, and a circular, upper end 41 connected to the stem 43 opposite the bottom end 42 by a fastener 43*a*. The sealing member 40 is slidably mounted within the plunger such that the upper end 41 may rest on the top 19 of plunger 16 and bottom end 42 is retained within the plunger by a number of projections 44 extending into the passages 24 in plunger 16.

When the chamber 25 is moving downwardly to expel the liquid out of the enclosure 37, the upper end 41 of the sealing member 40 abuts the upper portion 19 of the plunger 16. The upper end 41 thus closes the top of plunger 16, preventing any liquid contained within the enclosure 37 from flowing outwardly through the plunger 16. Therefore, as no fluid can escape the enclosure 37 other than through the outlet 34, the pressure exerted on the fluid contained within the enclosure is increased, resulting in an increased rate of fluid flow through the outlet 34 and hose 38.

When the chamber 25 is moved upwardly, the fluid entering the chamber 25 due to the vacuum formed by the chamber and the flexible member 13 pushes upwardly against the bottom end 42 of the sealing member 40, disengaging the upper end 41 from the top 19 of plunger 16. The fluid is then permitted to flow around the bottom end 42 and stem 43 into the enclosure 37. When the chamber 25 again moves in a downward direction, the pressure exerted by the closed end 29 of the chamber 25 on the upper end 41 forces the sealing member 40 downwardly into contact with the plunger 16, preventing any fluid flow into the enclosure 37.

Figure 4:
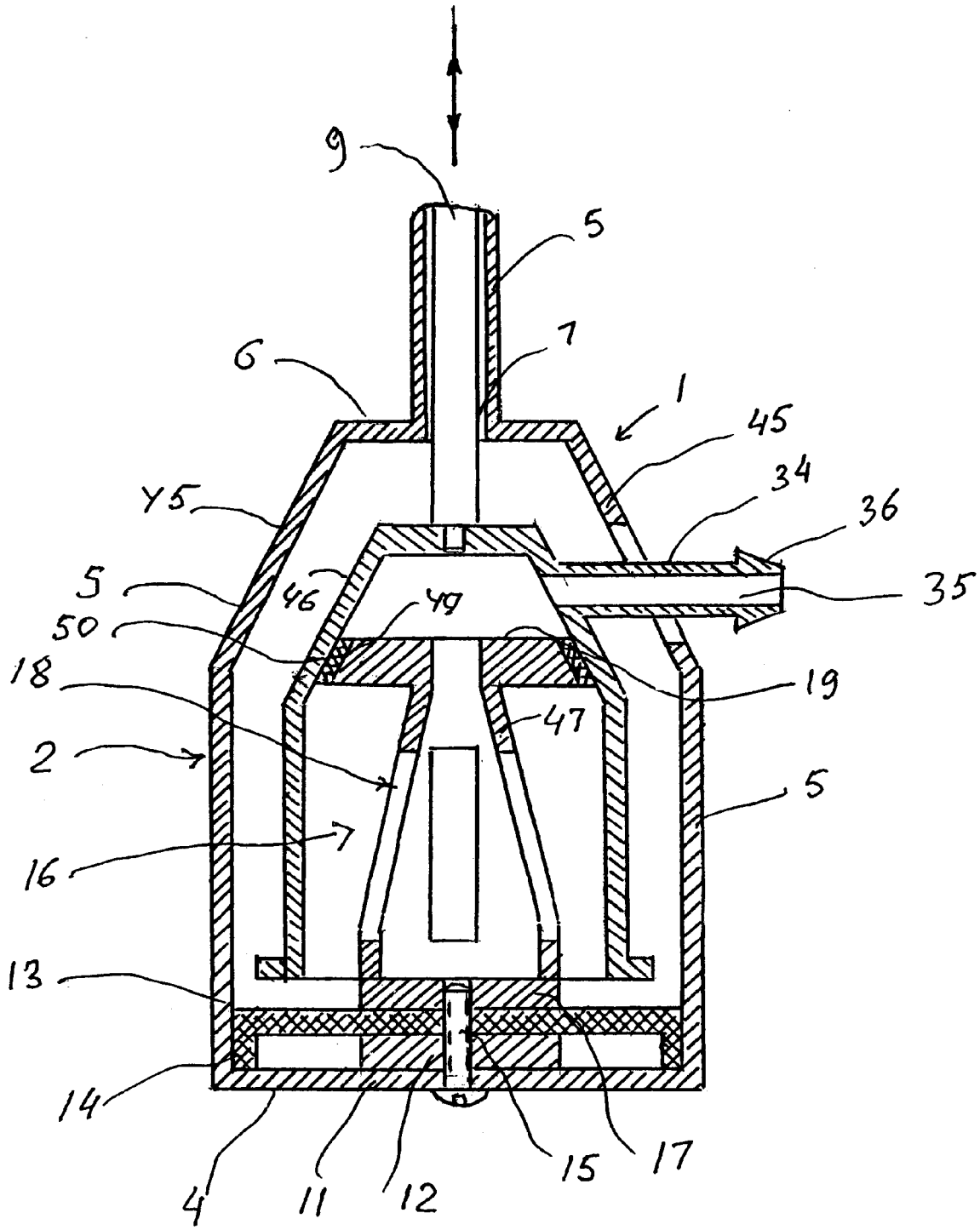
FIG. 4 is a cross-sectional view of a second embodiment of the inlet branch pipe of FIG. 2.

To increase the pressure of the outgoing fluid from the pump even further, an alternative embodiment of the present invention as shown in FIG. 4 may be used. In this embodiment, the pump case 2 is formed with a pair of angled portions 45 extending upwardly from the wall members 5 to narrow the width of the pump case at the upper end. Similarly, the cylindrical side wall of the mobile chamber 25 also includes a frustoconical upper portion 46 which tapers inwardly generally parallel to the angled sections 45 of the pump case 2. The outlet 34 is formed similarly to that found in the previous embodiment and extends from the frustoconical section 46 of the moveable chamber 25. The plunger 16 also includes a number of inwardly tapering side walls 47 extending from the base 17 towards the top 19 narrowing the upper diameter of the cylindrical portion 18. The outer edge of the outwardly extending flange 20 of the top 19 includes a sloping outer surface 49 that conforms to the slope of the upper angled wall section 45 of the moveable chamber 25. Disposed on the angled surface 49 is a resilient sealing member 50 that serves to engage the angled wall section 46 when the mobile chamber 25 is moved downwardly in a vibration sequence.

In operation, this embodiment increases the pressure at which the fluid is directed outwardly from the pump case 2 as the size of the enclosure 37 formed between the plunger 16 and the mobile chamber 25 is significantly reduced due to the slope given to both the sides of the mobile chamber 25 and the upper end 19 of the plunger 16. This reduced volume of the enclosure exerts a larger pressure on the fluid contained within the enclosure during the downward stroke of the shaft 9. The increased pressure within the enclosure translates to an increased rate of fluid flow exiting the pump through the hose 38 attached to the outlet 34.

Figure 5:
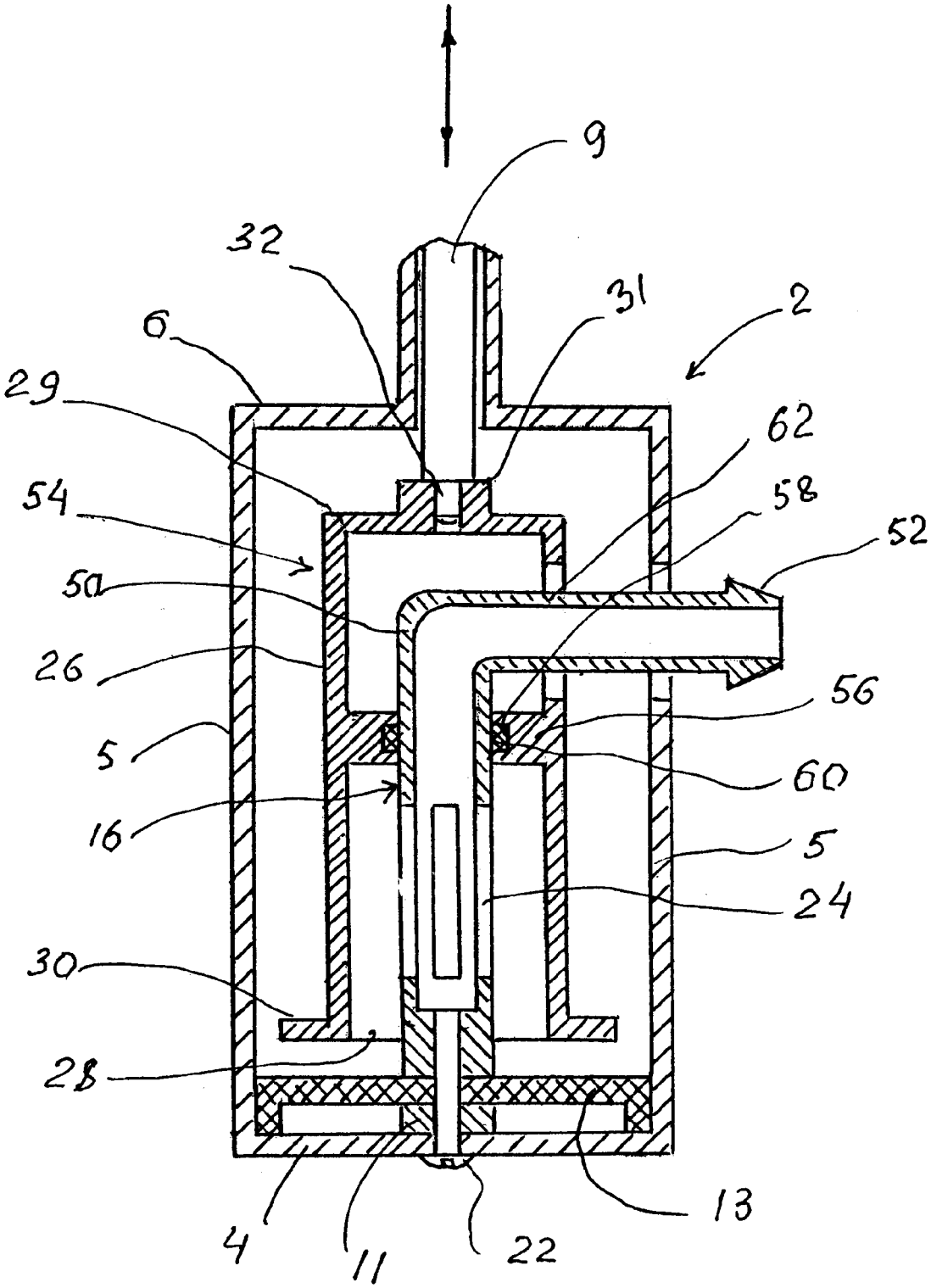
FIG. 5 is a cross-sectional view of a third embodiment of the inlet branch pipe of FIG. 2.

Still another embodiment of the pump case 2 is shown in FIG. 5. The pump case 2 is formed similarly to the case shown in FIG. 2 including the base 4, wall members 5, and cover 6. The pump case 2 also includes a flexible member 13 secured to the base 4 by a fastener 22 inserted through an opening 12 in a small annular shoulder 11 on the base 4.

This embodiment further includes a plunger 16 attached directly above the flexible member 13 by the fastener 22. However, the plunger 16 in this embodiment is a generally L-shaped tube 50. The end of the tube 50 secured to the base 4 includes a number of oval passages 24 that extend through the tube 50. Opposite the openings 24, the tube 50 terminates in an outlet nozzle 52 that extends past the wall member 5.

The mobile chamber 54 is cylindrical in shape and comprises a circular side wall 26 having a bottom, open end 28 and a top, closed end 29. The open end 28 includes an outwardly extending radial flange 30 that contacts and sealingly engages the flexible member 13 during operation of the apparatus. The closed end 29 includes a raised shoulder 31 having an opening 32 threadedly engagable with the shaft 9. The chamber 54 also includes a collar 56 extending radially inwardly from the side wall 26 of chamber 54. The collar 56 includes a notch 58 extending about the inner circumference of the collar 56 that receives an O-ring 60. The inner diameter of the collar 56 is slightly larger than the exterior diameter of the tube 50, such that when the O-ring 60 is positioned in the notch 58 on collar 56, the O-ring 60 sealingly engages the exterior of the tube 50. Above the collar 56, the chamber 54 also includes an opening 62 through which the plunger 16 extends. The opening 62 is generally oval in shape so that the opening 62 can move vertically about the plunger 16 when the chamber 54 is in motion without moving the plunger 16 as well.

In operation, the chamber 25 oscillates downwardly towards the flexible member due to the motion of the shaft 9. Water enters the interior of the chamber 25. Water inside the chamber 25 passes through the openings 24 into the interior of the tube 50. The water inside the tube 50 flows along the tube 50 and outwardly through the nozzle 52. When the chamber 25 contacts the flexible member 13, water is prevented from entering the chamber 25 in tube 50, such that the water exiting the tube 50 through the nozzle 52 creates a slight vacuum within the chamber 25. When the chamber 25 moves upwardly away from the flexible member 13, the slight vacuum existing within the chamber 25 causes water to be sucked into the chamber 25 and into the tube 50, continuing to flush water along the tube 50 through the nozzle 52.

The apparatus of this invention is particularly well suited for metering small volumes of corrosive liquids, such as acid, from large containers in which such liquids are typically shipped and stored. Also, due to the structure and operation of the pump apparatus, no measurable backpressure is generated during operation of the apparatus, enabling the fluid flow from the pump to terminate simultaneously with the deactivation of the generator.

Various alternatives and embodiments are contemplated as being within the scope of the following claims particularly pointing out and distinctly claiming the subject matter regarded as the invention.

We claim:

1. An inlet branch pipe for a vibratory pump comprising:

a pump case including a base, a cover and at least one wall connecting the base and the cover, the cover including a shaft opening adapted to receive an oscillating shaft;

a flexible member secured to the base within the pump case;

a hollow plunger having an upper end and a lower end secured to the base at the lower end over the flexible member, the plunger including a number of openings in communication with the interior of the plunger;

a movable chamber disposed within the pump case around the plunger, the chamber having an open end and a closed end opposite the open end, the closed end including a bore alignable with the shaft opening and adapted to engage the oscillating shaft; and a seal disposed between the plunger and the movable chamber to provide a water-tight seal therebetween.

2. The inlet pipe of claim 1 wherein the seal is contained within a collar extending inwardly from a side wall of the moveable chamber.

3. The inlet pipe of claim 2 wherein the plunger includes an outlet nozzle at the upper end, the nozzle extending through an opening in the movable chamber.

4. The inlet pipe of claim 1 wherein the seal is positioned in a groove extending around the circumference of the upper end of the plunger.

5. The inlet pipe of claim 4 wherein the chamber includes an outlet nozzle extending radially outwardly adjacent the closed end of the chamber.

6. The inlet pipe of claim 1 further comprising a slidable closure member including an upper panel adapted to engage the upper end of the plunger, a stem extending from the upper panel into the plunger, and a lower panel attached to the stem opposite the upper panel and adapted to engage the plunger to restrict the movement of the closure member.

7. The inlet pipe of claim 6 wherein the lower panel further comprises a number of projections that extend into and are slidably retained within the openings in the plunger to restrict the movement of the closure member.

8. A vibratory pump comprising:

a vibration generator having a shaft extending from the generator;

a pump case mounted to the shaft, the pump case including a base, a resilient member mounted to the base, at least one wall extending from the base adjacent the resilient member, and a cover connected to the wall opposite the base over the resilient member, the cover having an opening adapted to receive the shaft;

a plunger with a hollow center secured to the base above the flexible member, the plunger having an upper end and a lower end with a number of openings disposed between the upper and lower ends in communicating with the hollow center;

a moveable chamber disposed within the pump case around the plunger, the chamber having an open end facing the resilient member and a closed end opposite the open end, the closed end including a bore adapted to engage the shaft; and a seal located between the plunger and the moveable chamber to provide a water-tight seal therebetween.

9. A method for pumping a fluid comprising the steps of:

providing an inlet branch pipe including a pump case having a base, a cover, and at least one wall connecting the base and cover, the cover including a shaft opening adapted to receive an oscillating shaft, a flexible member secured to the base within the pump case, a hollow plunger having an upper end and a lower end secured to the base at the lower end over the flexible member, the plunger including a number of openings in communication with the interior of the plunger, a movable chamber disposed within the pump case around the plunger, the chamber having an open end facing the resilient member and a closed end opposite the open end, the closed end including a bore adapted to engage the oscillating shaft, and a sealing member located between the plunger and the movable chamber to provide a water-tight seal therebetween, inserting an oscillating shaft connected to a vibration generator through the shaft opening to engage the bore on the movable chamber; connecting a hose to the nozzle extending from the movable chamber; inserting the pump case into a container holding the liquid to be pumped; and switching on the vibration generator.

10. The method of claim 9 wherein the nozzle is formed integrally with the movable chamber adjacent the closed end.

11. The method of claim 10 wherein the seal is positioned within a groove extending around the circumference of the upper end of the plunger.

12. The method of claim 9 wherein the nozzle is formed integrally with the plunger and extends through an opening in the movable chamber adjacent the closed end.

13. The method of claim 12 wherein the seal is disposed in a collar extending radially inwardly from the movable chamber and engages the plunger.

* * * * *